US006705145B1

(12) United States Patent
Ohmae et al.

(10) Patent No.: US 6,705,145 B1
(45) Date of Patent: Mar. 16, 2004

(54) METHOD OF PROCESSING BENT AND DEFORMED PORTION OF METAL MATERIAL

(75) Inventors: Hideharu Ohmae, Osaka (JP); Susumu Okuji, Osaka (JP); Makoto Okuji, Nara (JP)

(73) Assignees: Matsushita Electric Industrial Co., Ltd., Osaka (JP); Okuji Kensan Co., Ltd., Osaka (JP)

( * ) Notice: Subject to any disclaimer, the term of this patent is extended or adjusted under 35 U.S.C. 154(b) by 0 days.

(21) Appl. No.: 09/707,143

(22) Filed: Nov. 6, 2000

(30) Foreign Application Priority Data

Nov. 19, 1999 (JP) ..... 11-329440

(51) Int. Cl.[7] ..... B21D 5/14
(52) U.S. Cl. ..... 72/177; 72/379.2
(58) Field of Search ..... 72/177, 179, 377, 72/379.2

(56) References Cited

U.S. PATENT DOCUMENTS

| | | | | | |
|---|---|---|---|---|---|
| 2,193,737 | A | * | 3/1940 | Penkala | 72/177 |
| 3,209,432 | A | * | 10/1965 | Cape | 72/177 |
| 3,877,275 | A | * | 4/1975 | Attwood | 72/177 |
| 4,279,139 | A | * | 7/1981 | Schmitz | 72/177 |
| 4,433,565 | A | * | 2/1984 | Preller | 72/177 |
| 5,272,899 | A | * | 12/1993 | Mediate | 72/177 |
| 5,890,388 | A | * | 4/1999 | Geranser et al. | 72/177 |
| 5,941,114 | A | * | 8/1999 | Kusaba | 72/177 |

FOREIGN PATENT DOCUMENTS

| | | | | |
|---|---|---|---|---|
| AU | 401679 | * | 5/1968 | 72/177 |
| DE | 33 43 709 | | 6/1984 | |
| EP | 0 953 386 | | 10/1999 | |
| JP | 56-84101 | * | 7/1981 | 72/177 |
| JP | 59-109466 | | 9/1984 | |
| JP | 62-156001 | * | 7/1987 | 72/177 |
| JP | 2-15801 | * | 1/1990 | 72/177 |
| JP | 3-32401 | * | 2/1991 | 72/177 |
| JP | 6-226389 | | 8/1994 | |
| JP | 6-246302 | | 9/1994 | |
| JP | 11-151526 | | 6/1999 | |

OTHER PUBLICATIONS

Copy of the European Search Report.

* cited by examiner

*Primary Examiner*—Daniel C. Crane
(74) *Attorney, Agent, or Firm*—Merchant & Gould, P.C.

(57) ABSTRACT

A metal material is rolled to form a strip plate material having a middle part and thinner thickness-deviation portions on both sides of the middle part. After that, this strip plate material is bent and deformed in its width direction by roll forming, thus forming a bent and deformed portion in the middle part. The processing method includes a rolling step and a roll forming step, which enables the metal material to be processed economically using relatively simple steps. No annealing step is included and therefore an excellent final product is obtained. Particularly, the rolling step and the roll forming step are carried out successively, so that the roll forming can be carried out with high efficiency using processing heat generated in the rolling step. The bent and deformed portion is thick and the thickness-deviation portions are thinner, which contributes to the reduction in weight of a final product while the same strength as that of a conventional product is maintained.

11 Claims, 8 Drawing Sheets

METHOD OF PROCESSING BENT AND DEFORMED PORTION OF METAL MATERIAL

BACKGROUND OF THE INVENTION

1. Field of the Invention

The present invention relates generally to a metal material for plastic processing and to a processing method for forming a bent and deformed portion in the same.

2. Related Background Art

In forming, for example, an angle-shaped bent and deformed portion in a metal material such as a strip-like material, a flat plate material, or the like, generally used methods include roll forming, push and bend forming, thrust bend forming, press-forming, or the like.

In addition, in the case of forming a special article such as a transverse frame for supporting a color selection electrode (a shadow mask) inside a cathode-ray tube, for instance, a round steel stick is subjected to hot rolling to have a predetermined angle shape and the shape is adjusted by drawing. Annealing then is performed, thus obtaining a product.

In a conventional processing method, however, only products with bent and deformed portions whose thickness is uniform throughout can be formed. Therefore, when such a product is to be applied to a member required to have a strength to a certain degree such as the above-mentioned frame for supporting the color selection electrode, the member becomes heavy inevitably.

When employing the above-mentioned rolling and drawing, high pressure and a great amount of heat are required in rolling, and an annealing step also is required. Consequently, not only the size of equipment as a whole and the production cost increase, but also a longer time is required for the processing and cracks may occur in the case of improper annealing.

SUMMARY OF THE INVENTION

It is an object of the present invention to provide a metal material for plastic processing, which can contribute to the reduction in weight of a product while maintaining substantially the same strength as that of a conventional product, can be processed economically with relatively simple steps, and provides an excellent final product, and to provide a processing method for forming a bent and deformed portion in the metal material.

In order to achieve the aforementioned objects, the present invention employs the following configurations.

In the method of the present invention, first, a metal material is rolled to form a strip plate material having a middle part and thinner thickness-deviation portions on both sides of the middle part. After that, this strip plate material is bent and deformed in its width direction by roll forming, thus forming a bent and deformed portion in the middle part.

According to the above-mentioned processing method, the bent and deformed portion formed by the roll forming has at least the same thickness as an original thickness of the metal material, and the thickness-deviation portions positioned on both sides of the bent and deformed portion are formed to be thinner in a rolling step prior to the roll forming. Therefore, while maintaining substantially the same strength as that of a conventional product, a plastically formed article with the bent and deformed portion can have a reduced weight.

Since the method of the present invention includes the rolling step and the roll forming step, the metal material can be processed economically using relatively simple steps. Moreover, no annealing step is included, and therefore an excellent final product can be obtained.

The quality and shape of the metal material are not particularly limited as long as the metal material is a steel material or another metal material suitable for plastic processing.

In the rolling step for forming the strip plate material from the metal material, thickness-deviation portions are formed to be reduced in thickness gradually from the middle part toward the ends of side portions positioned on both sides of the middle part. Furthermore, at a predetermined position in the middle part corresponding to an outer corner of a bent and deformed portion to be formed, a thick stripe portion is formed suitably. The thick stripe portion may be formed of one stripe, but also may be formed of two adjacent protruding stripes extending continuously along the length direction in the middle part of the strip plate material with the portion between the two protruding stripes being recessed in an arc shape. In the strip plate material with the middle part formed to be thicker than the thickness-deviation portions, the middle part is bent and deformed in its width direction by the roll forming and thus the bent and deformed portion is formed. In the rolling or the roll forming, a tapered face or a thick protruding portion may be formed at one or both of the ends of the thickness-deviation portions as required. According to the method of the present invention, the tapered face or the protruding portion, which has been provided in an independent step conventionally, also can be formed in the rolling step or the roll forming step, thus simplifying the steps.

For the rolling, warm rolling can be employed. However, it is preferable that rolling under ordinary temperature (cold rolling) is employed and the next step of roll forming is carried out while processing heat generated during the cold rolling still remains in the strip plate material. In other words, the rolling step and the roll forming step are carried out successively and therefore the roll forming can be carried out with high efficiency using the processing heat generated during the rolling.

It also is possible that the above-mentioned rolling step and roll forming step are not carried out as two separate steps but concurrently at substantially the same time.

In other words, while thinner thickness-deviation portions are formed on both sides of a middle part of a metal material by rolling of the metal material, the metal material may be bent and deformed in its width direction by roll forming to form a bent and deformed portion in the middle part. Furthermore, in forming the thickness-deviation portions, a thick stripe portion also may be formed at a predetermined position in the middle part corresponding to an outer corner of a bent and deformed portion to be formed, thus bending and deforming the metal material at a position of the thick stripe portion.

Even when the metal material is bent and deformed by roll forming while the thickness-deviation portions (and further the thick stripe portion as required) are formed by rolling as described above, the same effects as in the above can be obtained. Moreover, when the both steps are carried out concurrently, the forming steps can be simplified and the processing heat generated during the rolling can be used for the roll forming effectively, thus improving formation efficiency.

A metal material for plastic processing of the present invention is a material obtained after the completion of the above-mentioned rolling step. The metal material is formed of a metal plate having a middle part in its width direction and thinner thickness-deviation portions on both sides of the middle part, and the middle part is formed to be a bent and deformed portion.

Another metal material for plastic processing of the present invention is formed of a metal plate having a middle part in its width direction and thinner thickness-deviation portions on both sides of the middle part and also having a thick stripe portion at a predetermined position in the middle part corresponding to an outer corner of a bent and deformed portion to be formed, and the middle part is formed to be the bent and deformed portion.

When a bent and deformed portion is formed by roll forming or the like using such a metal material, an angle member with a reduced weight can be obtained while having the same strength as that of a conventional one.

The angle member thus obtained can be used as a supporting frame for a color selection electrode in a cathode-ray tube or a frame for reinforcement in an automobile.

DETAILED DESCRIPTION OF THE INVENTION

The present invention is described in detail based on embodiments shown in the figures as follows.

FIRST EMBODIMENT

Figure 1:
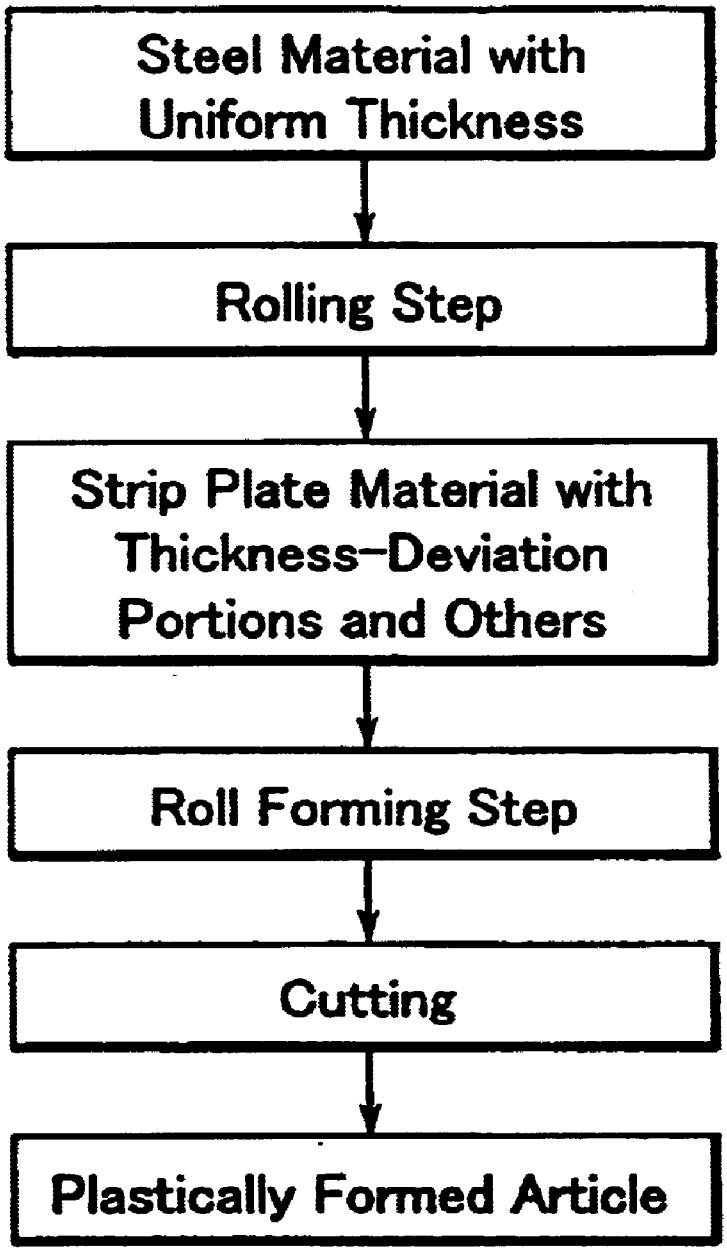
FIG. 1 is a block diagram showing a processing method according to the present invention.
Figure 2:
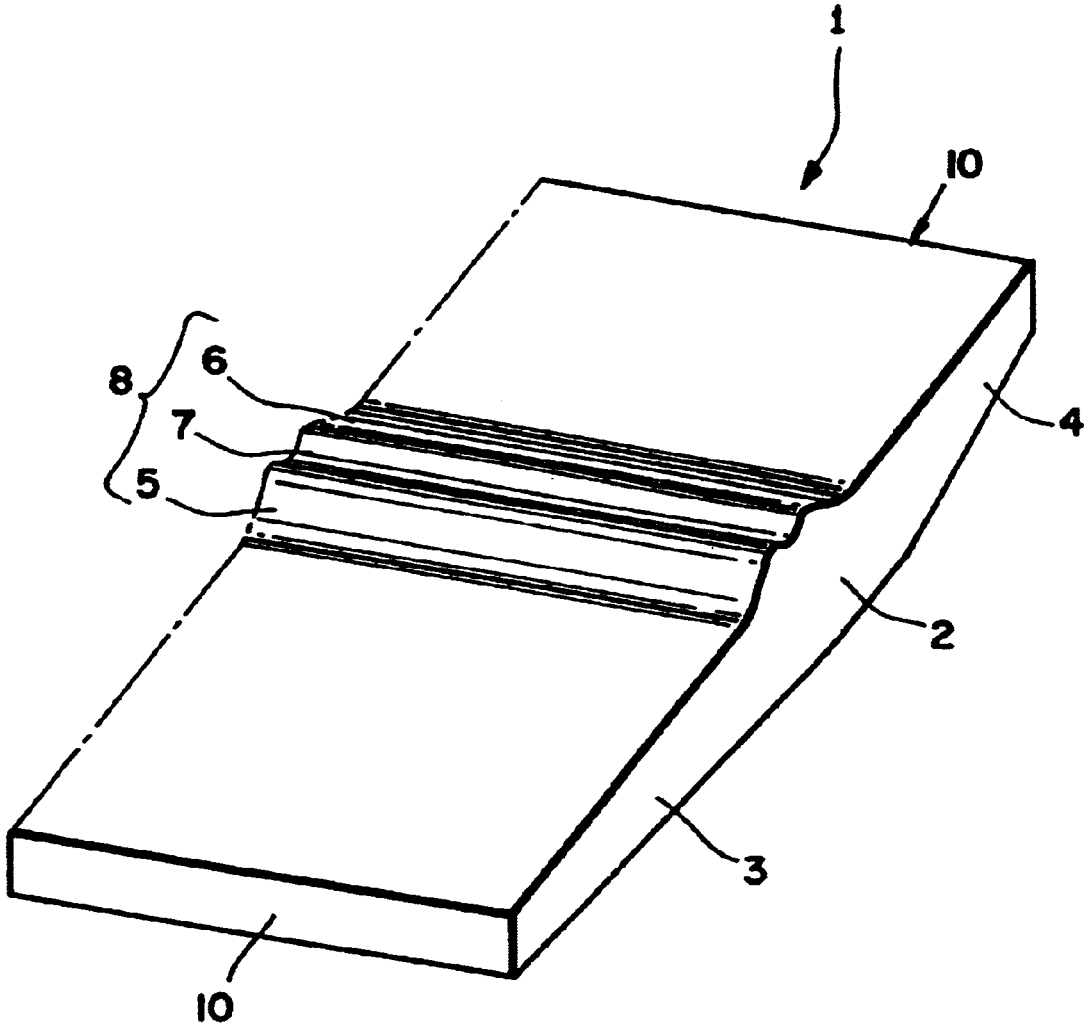
FIG. 2 is a perspective view of a strip metal material for plastic processing according to a first embodiment of the present invention.

FIG. 1 is a block diagram showing a process according to a first embodiment of the present invention. FIG. 2 is a perspective view of a metal material for plastic processing formed by a rolling step in the process.

A metal material 1 for plastic processing is formed of a strip-like steel plate and includes a middle part 2 to be bent and deformed and nonuniform thickness-deviation portions 3, 4 extending to the left and right continuously from the middle part 2. In the middle part 2, a thick stripe portion 8 having two stripes 5, 6 is formed on the upper surface shown in FIG. 2. The thick stripe portion 8 is in a location corresponding to an outer corner to be formed later by bending and deformation and is continuously formed along the longitudinal direction. Between the two stripes 5, 6, an arc-shaped recessed portion 7 is formed. The recessed portion 7 is at a higher level than that of the upper surfaces of the thickness-deviation portions 3, 4 of the steel plate.

The thickness-deviation portions 3, 4 are formed to be reduced in thickness gradually and slightly from the middle part 2 toward the left and right side ends 10 of the metal material 1 so as to have lower surfaces shown in FIG. 2 sloped in directions approaching their upper surfaces, respectively.

In forming this metal material 1, the rollers are brought into contact with the upper and lower surfaces and the left and right side ends 10 of a steel plate with a uniform thickness from the four directions, so that the thickness-deviation portions 3, 4 and the thick stripe portion 8 are formed while the steel plate passes between the rollers.

Figure 5:
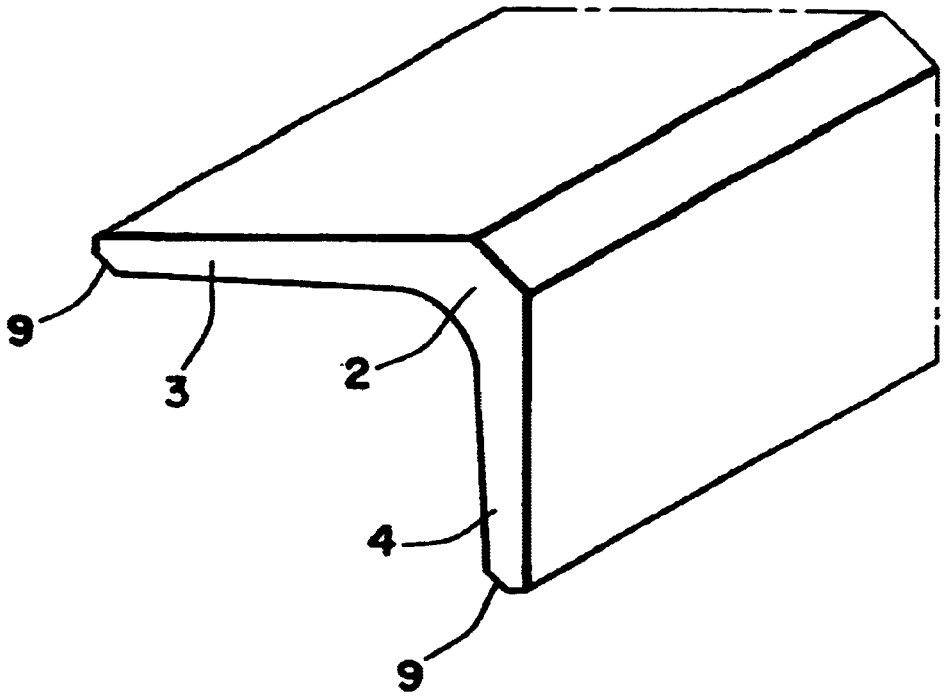
FIG. 5 is a perspective view showing a plastically formed article obtained by the processing method according to the first embodiment of the present invention.

After that, the metal material 1 is bent and deformed by roll forming so as to have the middle part 2 as a bent portion. The metal material 1 is bent and deformed with the thick stripe portion 8 being positioned outside. Then, the metal material 1 is cut to have a predetermined length, thus obtaining an angle member shown in FIG. 5 of a plastically formed article.

Preferably, the roll forming step is carried out successively to the rolling step. Since processing heat is generated in the metal material 1 by the rolling, bending and plastic deformation carried out by the roll forming while the processing heat still remains allow the metal material 1 to be bent with a relative ease and high efficiency.

Figure 3:
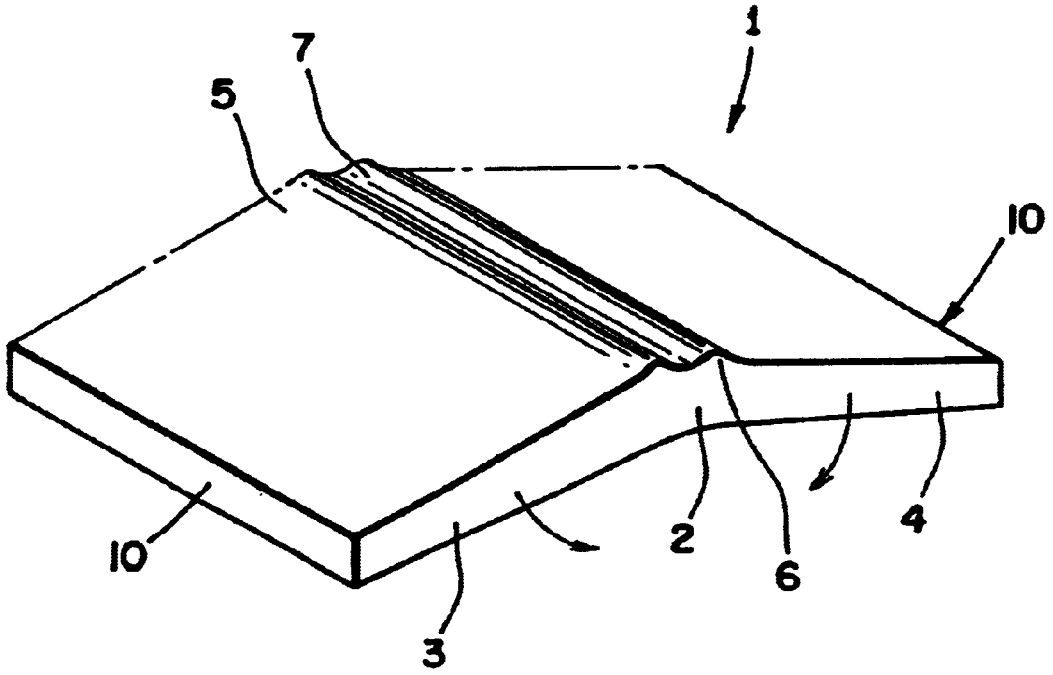
FIG. 3 is a perspective view showing a state where the strip metal material shown in FIG. 2 is bent and deformed by roll forming.
Figure 4:
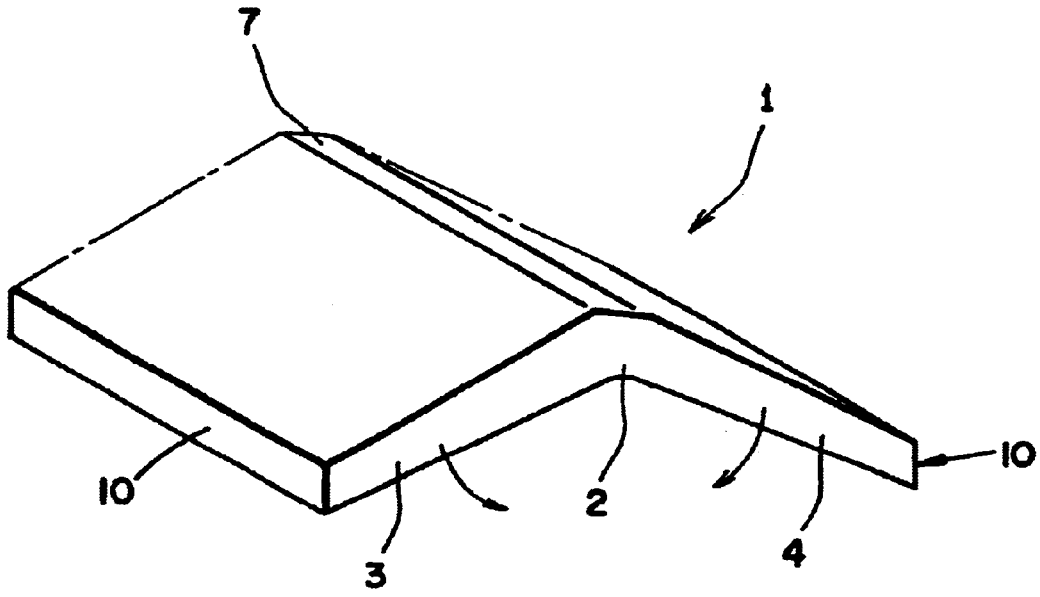
FIG. 4 is a perspective view showing a state wherein the strip metal material shown in FIG. 3 further is bent and deformed.

In the roll forming step, pressure rollers are brought into contact with the lower surface of the middle part 2 provided with the thick stripe portion 8 and the upper surfaces of the thickness-deviation portions 3, 4, respectively, and the middle part 2 is bent gradually, centered on the recessed portion 7. As a result, the left and right stripes 5, 6 of the thick stripe portion 8 are subjected to tensile forces in the directions away from each other. Consequently, as shown in FIGS. 3 and 4, the stripes 5, 6 come to have gradually gentle slopes and on the other hand, the recessed portion 7 rises up, thus obtaining a smooth form as a whole. Then, the metal material 1 is bent and deformed to have a predetermined bending angle, thus forming an angle member. In the roll forming step, tapered faces 9 are formed at the ends 10 of the thickness-deviation portions 3, 4 in their width direction. In this case, cutting blades or finishing rollers are brought into contact with the end faces utilizing the force with which the plate is forced out in the roll forming, thus forming the end faces of the thickness-deviation portions 3, 4 including the tapered faces 9 during the processing of the plate.

This angle member can be used, for example, as a transverse frame for a color selection electrode in a cathode-ray tube. The transverse frame obtained according to the present embodiment is formed so that the portions extending continuously from the bent and deformed portion are reduced in thickness gradually toward their ends to be thinner than an original thickness of the steel plate. Thus, the transverse frame is lighter than a conventional one. On the other hand, the bent and deformed portion itself maintains a sufficient thickness and therefore the transverse frame has substantially no difference in strength compared to the conventional one.

Heights of the respective stripes 5, 6 from the upper surfaces of the thickness-deviation portions 3, 4, an interval between the stripes 5, 6, a depth of the recessed portion 7, and the like are set suitably according to an elongation percentage of the plate, a bending angle, a curvature of the bent and deformed portion, or the like, and the positions, contact angles, and the like of the rollers in the rolling step are decided accordingly.

SECOND EMBODIMENT

Figure 6:
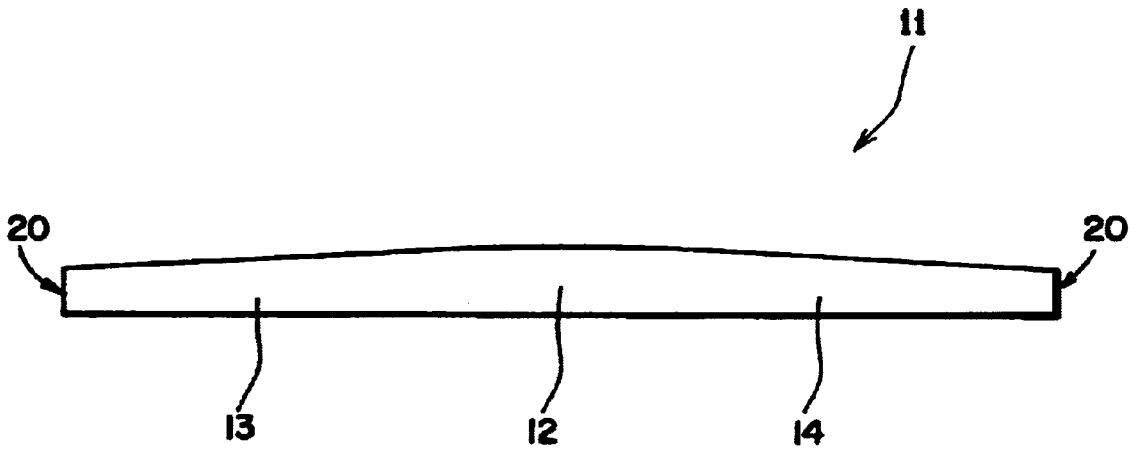
FIG. 6 is a side end view of a strip metal material for plastic processing according to a second embodiment of the present invention.
Figure 7:
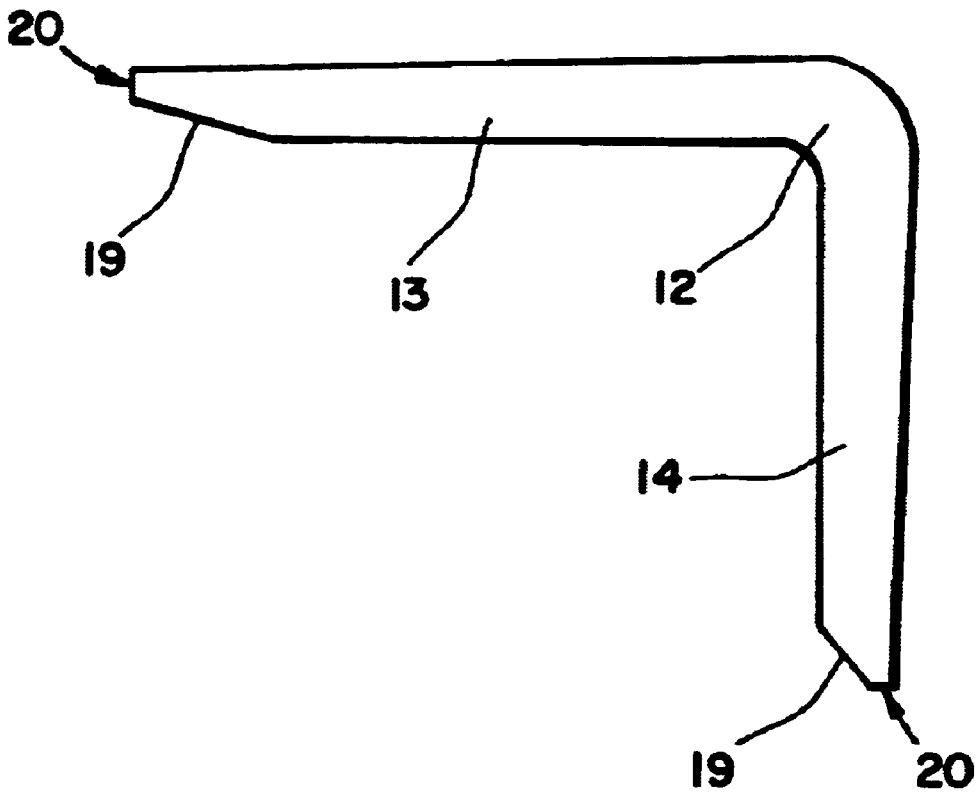
FIG. 7 is a side end view of a plastically formed article using the strip metal material shown in FIG. 6.

FIGS. 6 and 7 are a side end view of a metal material for plastic processing according to a second embodiment of the present invention and a side end view of the metal material in a bent state, respectively.

As shown in FIG. 6, a metal material 11 is formed to have an upper surface shown in the figure with gentle downward slopes from a middle part 12 toward both side ends 20, respectively, thus forming thickness-deviation portions 13, 14 on the left and right sides of the middle part 12. This embodiment is different from the first embodiment in that the middle part 12 is not provided with a thick stripe portion. The metal material 11 is formed through the same rolling step as in the first embodiment.

The metal material 11 is bent and deformed by roll forming with the center of the middle part 12 being set as the bending center, thus obtaining an angle-shaped product with an outer corner of the bent and deformed portion having substantial roundness as shown in FIG. 7. In this case, as in the first embodiment, tapered faces 19 may be formed at ends 20 of the thickness-deviation portions 13, 14.

Since the middle part 12 having no thickness deviation is set to be the bent and deformed portion, the same strength as that of a conventional one is maintained, and the reduced weight of the thickness-deviation portions 13, 14 allows the product obtained in the present embodiment as a whole to be lighter.

THIRD EMBODIMENT

Figure 8:
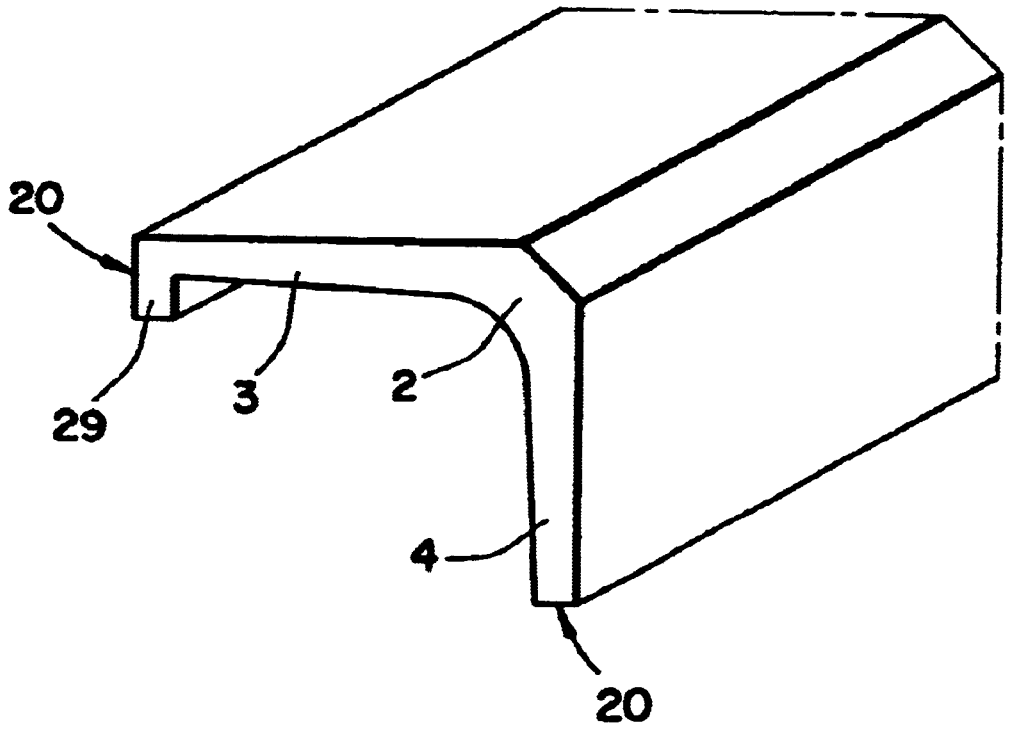
FIG. 8 is a perspective view of a plastically formed article obtained according to a third embodiment of the present invention.

FIG. 8 shows an angle member obtained according to a third embodiment. In FIG. 8, numeral 2 indicates a bent and deformed portion (a middle part), and numerals 3 and 4 denote thickness-deviation portions formed on both sides of the bent and deformed portion 2. In this case, the metal material 1 for plastic processing (see FIG. 1) according to the first embodiment obtained through the rolling step was used and was processed through the roll forming as in the first embodiment, thus obtaining the angle member shown in FIG. 8. In the first embodiment, the tapered faces 9 were formed at ends 10 of the thickness-deviation portions 3, 4 in the roll forming step. In the third embodiment, however, a protruding portion 29 is formed at the end 10 of one of the thickness-deviation portions 3, 4, in this case, the thickness-deviation portion 3, instead of a tapered face. The protruding portion 29 is formed substantially in parallel to the thickness-deviation portion 4 on the same side as that on which the thickness-deviation portion 4 extends with respect to the thickness-deviation portion 3. In this case, a roller is brought into contact with the end 10 of the thickness-deviation portion 3 in the roll forming as in the case of forming the tapered faces 9, thus forming such a protruding portion 29 concurrently with the formation of the bent and deformed portion.

The method of the present invention can be applied not only in the case where one substantially L-shaped bent portion is formed as in the first to third embodiments described above, but also in the case where a plurality of bent and deformed portions are formed in a metal material. In addition, bending angles can be set arbitrarily. When the plurality of bent and deformed portions are formed, a plurality of pairs of a middle part and both side portions sandwiching the middle part are required. To the respective pairs, rolling and roll forming are carried out.

Furthermore, it is not always necessary to form two protruding stripes in the thick stripe portion. According to the curvature or size of the bent and deformed portion, a single or a plurality of protruding stripes may be formed.

In the above-mentioned embodiments, the tapered faces and the protruding portion were formed in the roll forming step, but may be formed in the rolling step for forming the thickness-deviation portions by the same methods as described above.

In addition, a tapered face or a protruding portion can be provided at a required end as required. The side on which the tapered face is to be formed, the slope angle of the tapered face, the size of the protruding portion, the direction in which the protruding portion protrudes, or the like can be changed suitably according to intended use.

In the above-mentioned first to third embodiments, the rolling and the roll forming were carried out sequentially with respect to a steel material with a substantially uniform thickness to obtain an angle member with a substantially L-shaped cross-section, but the present invention is not limited thereto. That is to say, the rolling and the roll forming can be carried out at substantially the same time with respect to the steel material with a substantially uniform thickness to form a bent and deformed portion in the middle part of the steel material while thickness-deviation portions are formed on both sides of the middle part in the width direction of the steel material. This allows the forming steps to be simplified and the bent and deformed portion to be formed using the processing heat generated during the formation of the thickness-deviation portions effectively.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of processing a bent and deformed portion in a metal material, comprising:

forming a strip plate material by rolling the metal material, the strip plate material comprising:

a middle part that is continuous across a portion of a width of the strip plate material, wherein all of the middle part is thicker in a vertical direction than another part of the strip plate material;

ends of the metal material on both sides of the middle part;

thickness-deviation portions on both sides of the middle part that are reduced in thickness gradually from the middle part toward the ends on both sides of the middle part, at least one of the thickness-deviation portions being reduced in thickness continuously from the middle part to the respective end; and a thick stripe portion at a predetermined position in the middle part corresponding to an outer comer of the bent and deformed portion to be formed, wherein the thick stripe portion has two adjacent protruding stripes extending continuously in a length direction, and a portion between the protruding stripes is recessed in an arc shape; and bending and deforming the strip plate material in its width direction at only one discrete point in the thick stripe portion of the strip plate material by roll forming to form the bent and deformed portion.

2. The method of processing a bent and deformed portion in a metal material according to claim 1, wherein the portion recessed in an arc shape is thinner than another portion of the thick stripe portion.

3. A method of processing a bent and deformed portion in a metal material, comprising the steps of:

forming a metal material by rolling such that the metal material comprises:

a middle part that is continuous across a portion of a width of the metal material, wherein all of the middle part is thicker than another part of the metal material;

ends of the metal material on both sides of the middle part; and thickness-deviation portions on both sides of the middle part that are reduced in thickness gradually from the middle part toward the ends on both sides of the middle part, at least one of the thickness-deviation portions being reduced in thickness continuously from the middle part to the respective end;

forming a thick stripe portion at a predetermined position in the middle part, the position corresponding to an outer corner of a bent and deformed portion to be formed, wherein the thick stripe portion has two adjacent protruding stripes extending continuously in a length direction, and a portion between the protruding stripes is recessed in an arc shape; and bending and deforming the metal material in its width direction at only one discrete point in the thick stripe portion of the metal material by roll forming to form the bent and deformed portion.

4. The method of processing a bent and deformed portion in a metal material according to claim 3, wherein the thick stripe portion has two adjacent protruding stripes extending continuously in a length direction, and a portion between the protruding stripes is recessed in an arc shape.

5. The method of processing a bent and deformed portion in a metal material according to claim 4, wherein the portion recessed in an arc shape is thinner than another portion of the thick stripe portion.

6. The method of processing a bent and deformed portion in a metal material according to claim 3, wherein the portion recessed in an arc shape is thinner than another portion of the thick stripe portion.

7. A method of processing a bent and deformed portion in a metal material, comprising the steps of:

forming a strip plate material by rolling a metal material, the strip plate material comprising:

a middle part that is continuous across a portion of a width of the strip plate material, wherein all of the middle part is thicker in a vertical direction than another part of the strip plate material, and wherein the middle part has two adjacent protruding stripes extending continuously in a length direction, and a portion between the protruding stripes is recessed in an arc shape;

ends of the metal material on both sides of the middle part; and thickness-deviation portions on both sides of the middle part that are reduced in thickness gradually from the middle part toward the ends on both sides of the middle part, at least one of the thickness-deviation portions being reduced in thickness continuously from the middle part to the respective end; and bending and deforming the strip plate material in its width direction by roll forming to form a bent and deformed portion at only one discrete point in the middle part of the strip plate material.

8. The method of processing a bent and deformed portion in a metal material according to claim 7, wherein the portion recessed in an arc shape is thinner than another portion of the middle part.

9. A method of processing a bent and deformed portion in a metal material, comprising the steps of:

forming a metal material by rolling such that the metal material comprises:

a middle part that is continuous across a portion of a width of the metal material, wherein all of the middle part is thicker than another part of the metal material, and wherein the middle part has two adjacent protruding stripes extending continuously in a length direction, and a portion between the protruding stripes is recessed in an arc shape;

ends of the metal material on both sides of the middle part;

thickness-deviation portions on both sides of the middle part that are reduced in thickness gradually from the middle part toward the ends on both sides of the middle part, at least one of the thickness-deviation portions being reduced in thickness continuously from the middle part to the respective end; and bending and deforming the metal material in its width direction by roll forming to form a bent and deformed portion at only one discrete point in the middle part of the metal material.

10. The method of processing a bent and deformed portion in a metal material according to claim 9, wherein the forming the strip plate material is carried out by rolling of the metal material under ordinary temperature, and the bending and deforming is carried out by roll forming while processing heat generated in the rolling of the metal material under ordinary temperature is maintained in the strip plate material.

11. The method of processing a bent and deformed portion in a metal material according to claim 9, wherein the portion recessed in an arc shape is thinner than another portion of the middle part.

* * * * *